US007976446B2

(12) United States Patent
Chen

(10) Patent No.: US 7,976,446 B2
(45) Date of Patent: Jul. 12, 2011

(54) EXERCISE APPARATUS

(76) Inventor: Edward Chen, Kronberg Im Taunus (DE)

( * ) Notice: Subject to any disclaimer, the term of this patent is extended or adjusted under 35 U.S.C. 154(b) by 0 days.

(21) Appl. No.: 12/611,583

(22) Filed: Nov. 3, 2009

(65) Prior Publication Data

US 2010/0113233 A1 May 6, 2010

(30) Foreign Application Priority Data

Nov. 4, 2008 (EP) ..... 08019307

(51) Int. Cl.
*A63B 21/00* (2006.01)

(52) U.S. Cl. ..... 482/133

(58) Field of Classification Search ..... 482/133, 482/142, 126, 140, 139, 407–408, 91, 92–97, 482/135–138, 148; 601/1, 5
See application file for complete search history.

(56) References Cited

U.S. PATENT DOCUMENTS

| | | | | |
|---|---|---|---|---|
| 4,666,153 | A | 5/1987 | Soble | |
| 6,962,554 | B2 * | 11/2005 | Keiser | 482/112 |
| 2008/0182730 | A1 * | 7/2008 | Conley et al. | 482/95 |

FOREIGN PATENT DOCUMENTS

| | | | |
|---|---|---|---|
| DE | 19744540 | A1 | 4/1999 |
| WO | WO-2005/011815 | A2 | 2/2005 |
| WO | WO-2007/026178 | A1 | 3/2007 |

* cited by examiner

*Primary Examiner* — Lori Baker
(74) *Attorney, Agent, or Firm* — Connolly Bove Lodge & Hutz LLP

(57) ABSTRACT

An exercise apparatus containing a supporting stand and at least one force transmission element, which is associated with a handle element and a pressure exerting element, the apparatus being suitable to exert pressure onto the knee area of a human user and the apparatus allowing the movement of the pressure-exerting element from a first position, in which the pressure-exerting element is in an anterolateral position relative to the body of the user, to a second position of the pressure exerting element, in which the pressure-exerting element is in an posterolateral position, while the pressure-exerting element exerts pressure onto the knee area of the human user. In another aspect, the invention encompasses an exercise apparatus containing a supporting stand and at least one force transmission element, which is associated with a handle element and a pressure-exerting element, in which the force transmission element is movable about a first pivot, wherein the first pivot is positioned in a ventral position relative to the body of a human user.

20 Claims, 6 Drawing Sheets

EXERCISE APPARATUS

CROSS REFERENCE TO RELATED APPLICATIONS

This application claims the benefit of European application No. 08019307.1 filed Nov. 4, 2008, which is incorporated by reference in its entirety for all useful purposes.

FIELD OF THE INVENTION

The present invention concerns an exercise apparatus. Such an apparatus can be used to increase the general physical fitness of a user. The present apparatus, however, is also useful to increase the mobility of parts of the body, in particular of the lower back and the anatomical structures it comprises. It can therefore be used for prevention as well as therapeutic purposes. The apparatus may be used in a medical environment (e.g. a chiropractor, an orthopedic practice, a rehabilitation center, etc.) or in a sports or private environment (e.g. in a gym or fitness club, etc.).

A variety of exercise apparatuses is known. WO 2005/011815 discloses an exercise apparatus, which comprises foot supports and handles and is thereby designed to engage the whole body. While this exercise apparatus appears suitable for cardio training and appears to support a coordinated movement of the arms and legs, the apparatus does not seem to allow for stretching or activating the mobility of specific parts of the body. The apparatus also does not seem to have any direct effect on the spine. Moreover, it should be noted that the energy created when using the apparatus is not directed to any part of the body as to have any localized positive effect onto the body.

WO 2007/026178 discloses another exercise apparatus, which is described to be useful in abdomen muscle training. While the construction is relatively simple and the apparatus also engages all parts of the body, in a given set-up, the body weight of the user seems to define the weight experienced in the muscle training. Therefore, the user cannot freely and easily adapt the force effectively during an exercise.

DE 19 744 540 discloses an exercise apparatus specifically designed to strengthen the back and arm muscles. A user is supposed to pull a handle bar and has to overcome the force created either by a spring or by a piston and cylinder unit.

U.S. Pat. No. 4,666,153 discloses an apparatus for self-manipulation of the spinal vertebrae. This apparatus comprises a frame holding a panel, such that essentially a stretcher is provided on which a user can lie down. This stretcher comprises side posts and guides that serve as a hold-down device for the upper torso of a user. At the lower end, the frame supports a post that has a lever secured thereto. During use of the apparatus, both legs of a user are preferably located on one side of the post at the lower end, and in the described exercise position, one leg rests upon the other leg. The user is supposed to grasp the lever with one hand and exert pressure onto himself (or herself) for rotating his (or her) lower torso in one direction. This twisting motion is portrayed to have a stretching effect on the back muscles and to relieve back pain by repositioning spinal vertebrae. While it is believed that the described movement can have beneficial effects, the described apparatus does not seem to provide a desirable level of ease and effectiveness of use. Many users will perceive the hold-down device as somewhat uncomfortable. A device of this kind may be acceptable in the medical area, but typically it does not appear acceptable in an environment used for fitness and sports. In a further aspect, the lever is to be held with a single arm and in a position where it is difficult to build up sufficient force. Moreover, the roll-over movement seems to be enabled only with a limited degree of freedom as the panel does not allow one knee to move much below the level of the other knee. Therefore, the twist angle for the spinal vertebrae is rather limited.

Hence, the present invention provides an improved exercise apparatus and overcomes the disadvantages of the prior art.

SUMMARY OF THE INVENTION

In one aspect, an exercise apparatus comprises a supporting stand and at least one force transmission element, which is associated with a handle element and a pressure exerting element. The apparatus is suitable to exert pressure onto the knee area of a human user and the apparatus, allowing for movement of the pressure-exerting element from a first position, in which the pressure-exerting element is in an anterolateral position relative to the body of the user, to a second position, in which the pressure-exerting element is in a posterolateral position, while the pressure-exerting element exerts pressure onto the knee area of the human user.

In another aspect, the invention encompasses an exercise apparatus comprising a supporting stand and at least one force transmission element, which is associated with a handle element and a pressure exerting element. The force transmission element is movable about a first pivot, wherein the first pivot is positioned in a ventral position relative to the body of a human user.

DETAILED DESCRIPTION

Figure 1:
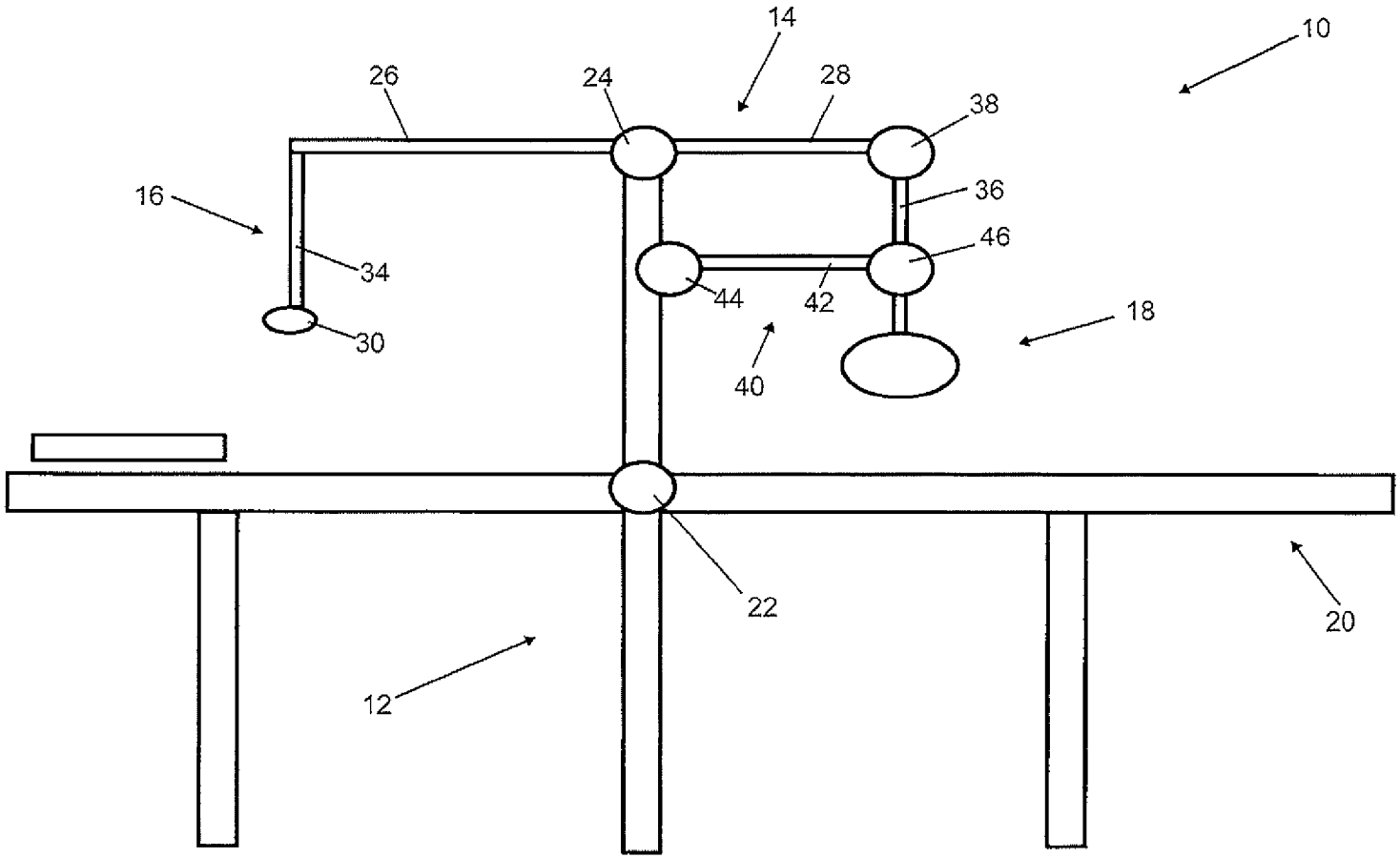
FIG. 1 is a side view of the apparatus, while the apparatus is in a neutral position.

The exercise apparatus according to the present invention can have a variety of usages. One field of usage is the medical and therapeutic field. Especially in this field, the apparatus is used under medical supervision, e.g. by a doctor, orthopedic, chiropractor, or with assistance, from example of a nurse, physical therapist, fitness instructor and the like. The exercise apparatus, however, is equally suitable for the field of fitness exercise and could for example find its place in a public or private gym or other sports facilities.

The exercise apparatus comprises a supporting stand and a force transmission element. The supporting stand can be of a variety of shapes and sizes. A function of the supporting stand is to provide support for the force transmission element at a given height above the floor (or of another supporting surface). The supporting stand, therefore, can have one leg, two legs, four legs or any number of legs.

The transmission element is associated with a handle element and a pressure-exerting element. The handle element can have any suitable shape, which can be held by a user and can be used to transmit force from the upper body, the hands and/or the arms of the user. The handle element can, for example, comprise a handle bar with gripping areas either in the center or at both ends of the bar. The handle element can be suitable to be held by a single hand or by both hands of a user. It can be a multiple piece or a single piece element.

The pressure-exerting element can exert pressure onto the user and typically will be in contact with an area of the lower body of the user, such as the knee area. The element should be sufficiently flat and large enough to avoid the induction of any pain or risk of injury (and hence it should not be sharp or pointy). Further, at least the surface of the pressure-exerting element which will be in contact with the user, e.g. the knee of the user, is preferably made of a non-skid material. Typically, the pressure-exerting element will comprise some cushioning. According to the present invention, the pressure-exerting element can also be anatomically optimized as to reflect the shape of the body part onto which pressure is exerted. For example, it could comprise a concavity or convexity suitable to surround or embed the knee of a user.

The force transmission element transmits force from the handle element to the pressure-exerting element. A variety of shapes and forms is useful for the force transmission element. Normally, some rigidity is required to not only transmit a pulling force but also to transmit a pushing force. The force transmission element can, for example, comprise one or more rigid arms.

When the exercise apparatus is used, the pressure-exerting element is moved from a first or starting position to a second or final position. The first position is an anterolateral position relative to the body of a user. As used herein, an anterolateral position is one that is generally in front of the body of the user and at the same time either somewhat to the left or somewhat to the right of the center axis of the user's body (i.e. on one side of the sagittal plane). The second position is a posterolateral position. As used herein, a posterolateral position is one that is on one side of the sagittal plane and at least slightly more dorsal to the anterolateral position (i.e. more towards the back of the user).

The apparatus allows for the pressure-exerting element to exert pressure onto the knee area of a human user. The apparatus is preferably designed to be used by a human user in a supine position. This pressure can be fully user generated and hence come from the force of the upper body (e.g. the arms) of the user. The pressure can also, at least in part, be created by other devices. For example, at least a portion of the pressure could come from a device loaded with mechanical energy, such as a spring mechanism, or additionally or alternatively stem from an engine, such as an electric motor.

When using the apparatus, as the user exercises his upper body, the handle element will be used to trigger the movement of the pressure-exerting element. Further, the user also exercises the lower body by simultaneously performing a twisting or gyrating motion along his longitudinal axis. At least one knee is moved between the first and the second position. It is well known that this specific movement of one knee from an anterolateral to a posterolateral position can have a positive stretching and mobilization effect on the lower back, the hip joint and thigh muscles. A very positive effect is achieved if, for example, the left knee is lifted towards the central body and moved over the stretched right leg positioned below the left leg. A downward movement of the upper (in this case: left) knee to a posterolateral position will then affect the hips and the spine of a user. Naturally, the corresponding movement can also be made onto the contralateral side with the right knee. This movement, at least to a certain extent, resembles a manipulation maneuver for the chiropractic adjustment of the lower back and the sacroiliac joint (commonly referred to as the "SI-joint"). The respective maneuver normally requires a sufficiently experienced medical/orthopedic doctor or chiropractor. This sequence of actions is also called the "lumbar role." The apparatus, however, enables all users to make the respective movement triggered by their own hands either with or without any supervision or help.

For maximum exercise efficiency, the body of the user can be supported when using the apparatus, for example, with a bench that provides a support surface for the lower-back and/or leg(s) of the human user. The support surface can be essentially even and should support at least the lower back of the human user. The term bench is used herein to generally refer to a support surface and also encompasses a bed or a therapy table. Of course, the bench can have additional anatomical supports, for example a backrest, which also can be adjusted in position and angle. Often at least one cushion is part of the anatomical support to support the head, back or leg of the user, for example.

The apparatus can be releasably attached to such a bench as to have a fixed position relative to the bench. In a further aspect, such an attachment can provide further physical support to the apparatus. For example, the supporting stand can be attached to the bench. This attachment is made by an attachment element. The supporting stand and a portion of the bench can, for example, have matching holes such that bolts can join the bench and the supporting stand. Another suitable attachment element is a clamp. A variety of adhesive or mechanical attachment elements are also suitable. When a releasable attachment is used, the apparatus can be used with different benches. If the apparatus is to be used on an immobile patient who's body dimensions fits the apparatus it could be used with the bed or bench used already by the patient without the need to move the patient.

According to the present invention the apparatus can alternatively be permanently attached to the bench. This will require the use of the apparatus with only one and the same bench; however, the attachment can then be more rigid than is typical for a releasable attachment. In one embodiment, the supporting stand can be integrated to the bench, which can result in a more elegant and economical construction.

When the apparatus is used with a bench, the first position of the pressure-exerting element is above the support surface of the bench and the second position is below this support surface.

The apparatus will typically be used to exert pressure either on the left knee or on the right knee of the user (notably, for exerting pressure onto the left knee, the pressure-exerting element will normally be on the right side of the user who is in a partly supine and partly right lateral position and vice versa). According to the present invention, however, it can be sufficient that the apparatus comprises only one pressure-exerting element. This pressure-exerting element can then be moved to between at least one position on the left side of the user's body and at least one position on the right side of the user's body.

Alternatively, an apparatus can be provided which comprises a second pressure-exerting element, which is on the user's other lateral side with the first pressure-exerting element. The second pressure-exerting element can be at the same height as the first pressure-exerting element such that the movement of these elements is parallel.

The force transmission element should be mounted to the supporting stand in some suitable way. In many embodiments, the force transmission element can be moved with respect to the supporting stand. Therefore, the force transmission element can be pivotally mounted to the apparatus, and specifically mounted to the supporting stand, using a first pivot.

While such a first pivot can be in a variety of positions, it has been found beneficial to provide the first pivot in a position that is proximal to the knee of the human user (i.e. towards the central body of the user). Such a position of the first pivot allows an easy and very well controllable transmission of forces between the upper body and the lower body of a user.

According to the present invention, the first pivot can be in a position, which is ventral to the body of the human user. Again, this allows for a very controlled and limited transmission of force from the user's upper body to the user's lower body. It will also allow the user to watch the action of the force transmission element, which provides a feeling of affirmation and comfort, as well as an easy understanding of the function of the exercise apparatus.

As said, the supporting stand may comprise only a single leg. Such a construction is sufficient, especially if the supporting stand is permanently or releasably attached to the bench. It may also be the construction of choice, if only a single pressure-exerting element is provided, which can be moved from one side of the bench to the other.

In another embodiment, the supporting stand for the apparatus will comprise one leg on either side of the user. This can give the supporting stand equal support on either side. Of course, the supporting stand can also comprise more legs, for example four legs.

A variety of handle elements is suitable, for example, the handle element can comprise two gripping elements.

The position of the handle elements can be adjusted relative to the other portions of the force transmission element. This allows for selecting an optimized position depending on the size of the user, but also depending on the amount of force to be exerted. Likewise, the position of the gripping element (s) can be adjusted relative to the other portions of the force transmission element.

The position of the pressure exerting elements may also be adjusted relative to the other portions of the force transmission elements. While the pressure-exerting elements can be moved between at least two positions, such an adjustable mechanism allows for defining the first position and the second position, depending on the anatomy of the user.

It is also useful to provide an apparatus in which the force transmission element comprises a first lever on one side of first pivot and a second lever on the other side of the first pivot and in which the first lever is on the same side as the handle element relative to the first pivot and the second lever as the same side as the pressure-exerting element relative to the first pivot. This allows for ease of use and an easy understanding of the force transmission element.

The apparatus may also comprise an arm that joins the handle element to the first lever. The apparatus can further comprise an arm that joins the pressure element to the second lever. Both arms can be adjusted in length. The arms can also be adjusted in angle relative to the first and second levers, respectively. This also allows for adapting the apparatus to the anatomy of the user. The length adjustment can, for example, be achieved by a telescopic mechanism with an inner and an outer tube or by a thread bar movable into and out of a thread.

The apparatus can comprise at least one guiding element to guide the pressure-exerting element in a predetermined direction. A variety of guiding elements is suitable. For example, elements that allow for some freedom of movement, but restrict the freedom of movement within certain limits, are suitable. Such elements can comprise slits or windows through which a bar or an arm is guided. A suitable guiding element can limit the direction of a movement to provide for mainly a vertical force direction. Such guiding elements can be constructed using linkages. In particular, planar linkages and four bar linkages are generally suitable. One suitable guiding element is a parallelogram linkage.

Generally, an exercise apparatus is within the scope of the present invention which comprises a supporting stand and at least one force transmission element, which is associated with a handle element and a pressure-exerting element and in which the force transmission element is movable about the first pivot, wherein the first pivot is positioned in a ventral position to the body of the human user. Such an exercise apparatus has been found to be an easy and economical construction, while at the same time allowing for a very controlled and easy force transmission. In one execution of such an apparatus, the first pivot is positioned in a ventral position below the chest and proximal of the hips of the human user.

FIG. 1 gives a side view of one embodiment of an exercise apparatus according to the present invention. The apparatus comprises a supporting stand (12) that comprises two essentially vertical legs. The supporting stand supports a force transmission element (14). The force transmission element is associated with a handle element (16) and is further associated with a pressure-exerting element (18). The exercise apparatus (10) is shown with a bench (20) and is attached to the bench by the attachment element (22). The link between the supporting stand (12) and the force transmission element (14) is made by a first pivot (24). A first lever (26) is provided on one side of the first pivot (24) and a second lever (28) is provided on the other side of the first pivot (24). The force transmission element (14) essentially comprises a straight bar comprising the first lever (26) and the second lever (28), the bar being joined by the first pivot (24) to the supporting stand (12). As shown, the first lever (26) and the second lever (28) can be provided by a single piece of material. Of course, the first lever (26) and the second lever (28) can also be provided from distinct pieces of material. Both levers, as the other elements of the force transmission element, can also by themselves comprise a plurality of elements.

On the side of the first lever (26) two gripping elements (30) are found. These gripping elements (30) are positioned at the ends of a gripping bar (not shown in this Figure). The gripping bar can be a single piece or two pieces. The gripping elements (30) are linked to the first lever (26) by an arm (34). The arm (34) is rigidly attached to the first lever (26) (alternatively a further pivot or any other movable or pivotable connection could be provided between the arms (34) and the first lever (26)).

The second lever (28) is connected to the pressure-exerting element (18) by a further arm (36). This arm (36) is adjustable in length. The arm (36) is joined to the second lever (28) by a pivot (38). A guiding element (40) is provided for the pressure-exerting element (18) and guides the arm (36). The guiding element (40) comprises a guiding arm (42) and a first guiding pivot (44) joined to the supporting stand and a second guiding pivot (46) joined to the arm (36). In this construction, the guiding arm (42) forms together with a portion of the arm (36) the second lever (28) and a portion of the supporting stand (12), a planar four-bar linkage which is a parallelogram linkage. Hence, the arm (36) and the pressure-exerting element (18) will remain in a mainly vertical orientation while moving up or down.

Figure 2:
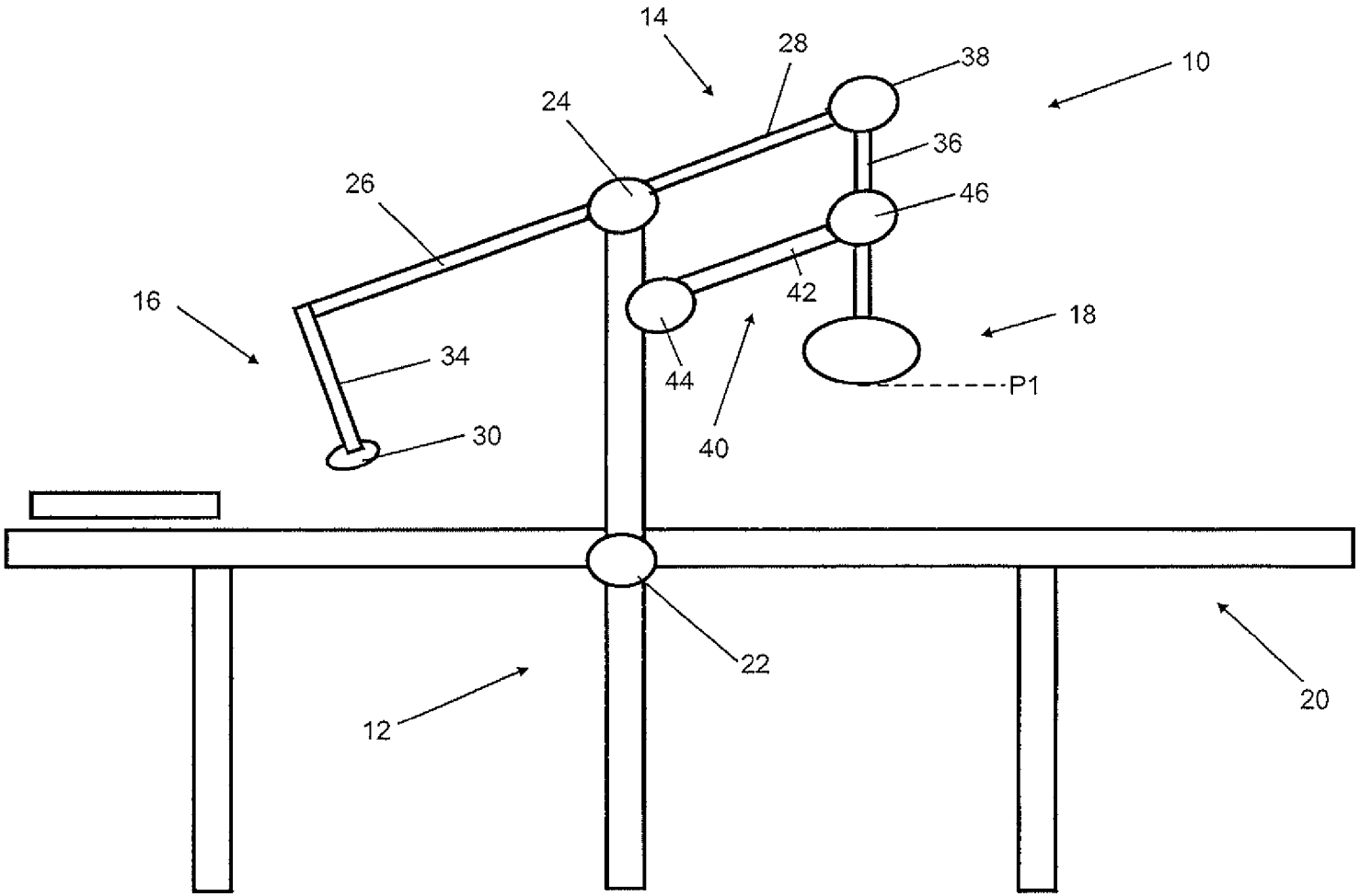
FIG. 2 is a side view of the apparatus, while the apparatus is in an initial or starting position.

FIG. 2 is essentially the same side view as FIG. 1 but provides a view of the embodiment in a different position. This position could be referred to as the initial or start position. In this position, the pressure-exerting element (18) is in its first position (P1) and above the bench level. It allows a user to lie on the bench (20) and to move, for example, the left leg above the right thigh as to position the left knee underneath the pressure-exerting element (18).

Figure 3:
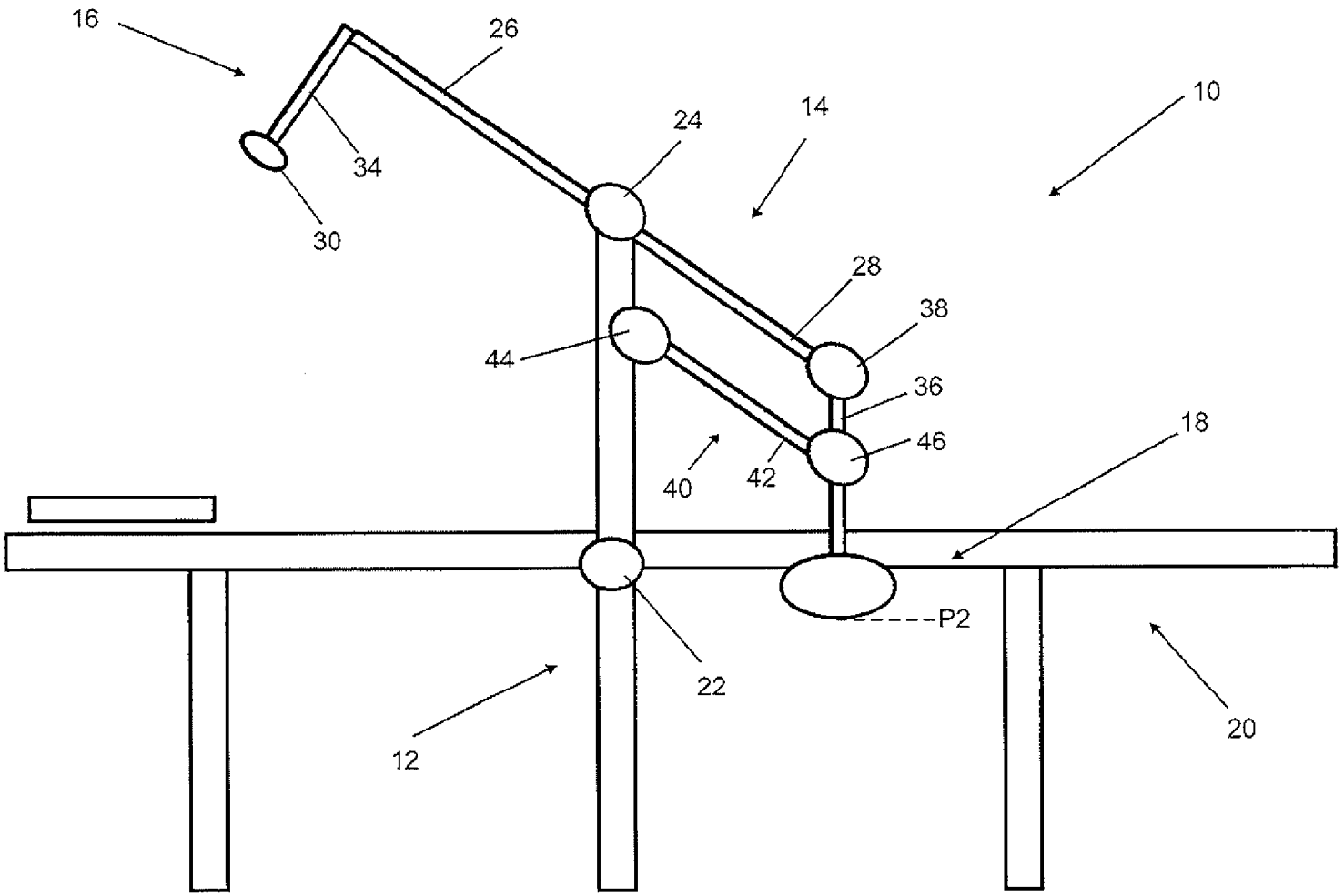
FIG. 3 is a side view of the apparatus, while the apparatus is in a final or fully pushed down position.

FIG. 3 provides the same side view onto the same apparatus, but in a lowered position, also referred to as the final position. In this position, the pressure-exerting element (18) is in its second position (P2). As compared to FIG. 2, the pressure-exerting element (18) has performed a vertical downward movement and is now positioned underneath the bench level. The gripping elements are above the chest of a human user and in this position can be gripped with stretched arms.

Figure 4:
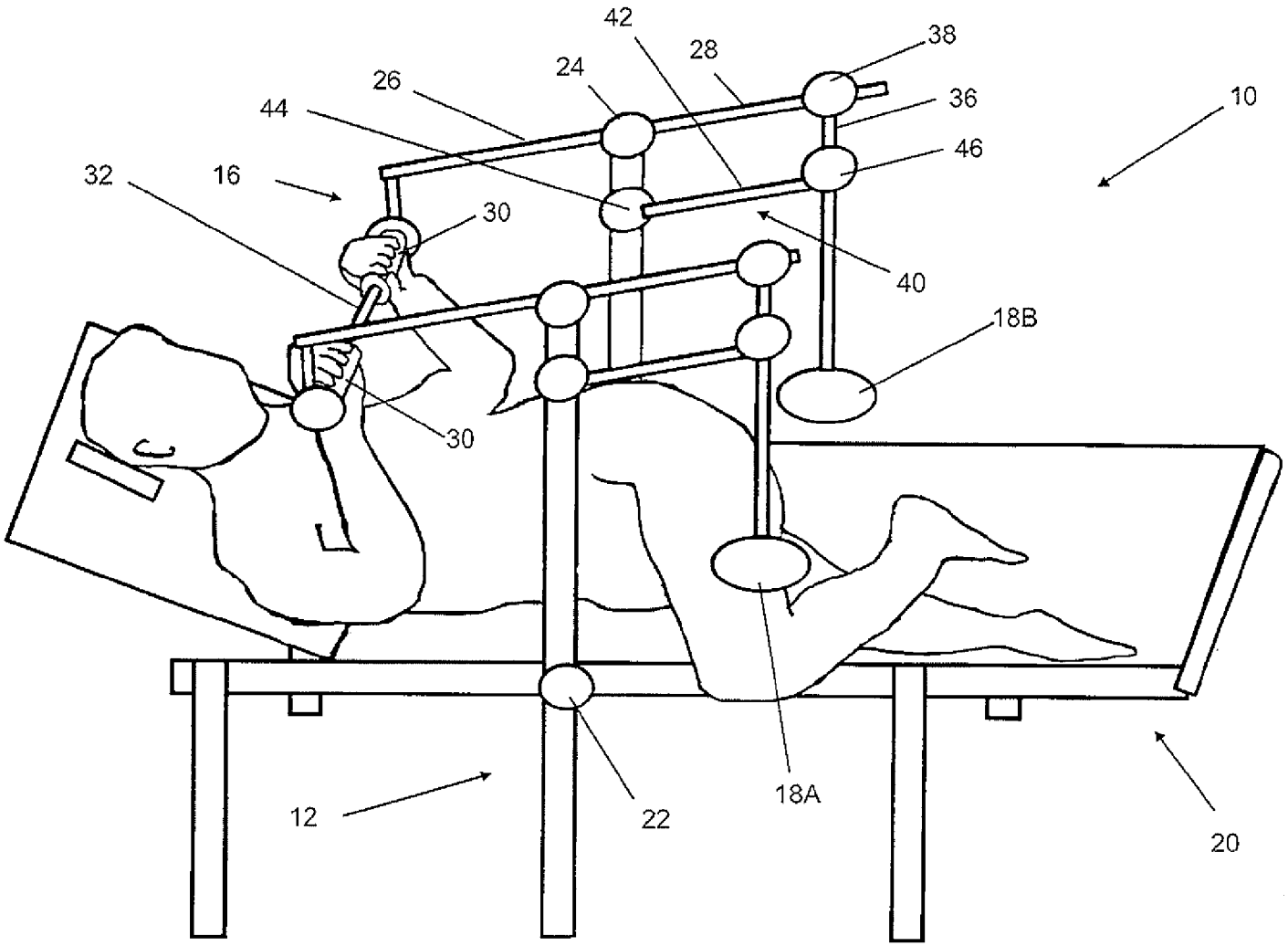
FIG. 4 is a perspective view of the apparatus that schematically also shows the position of a user. The apparatus is essentially shown in the initial position.
Figure 6:
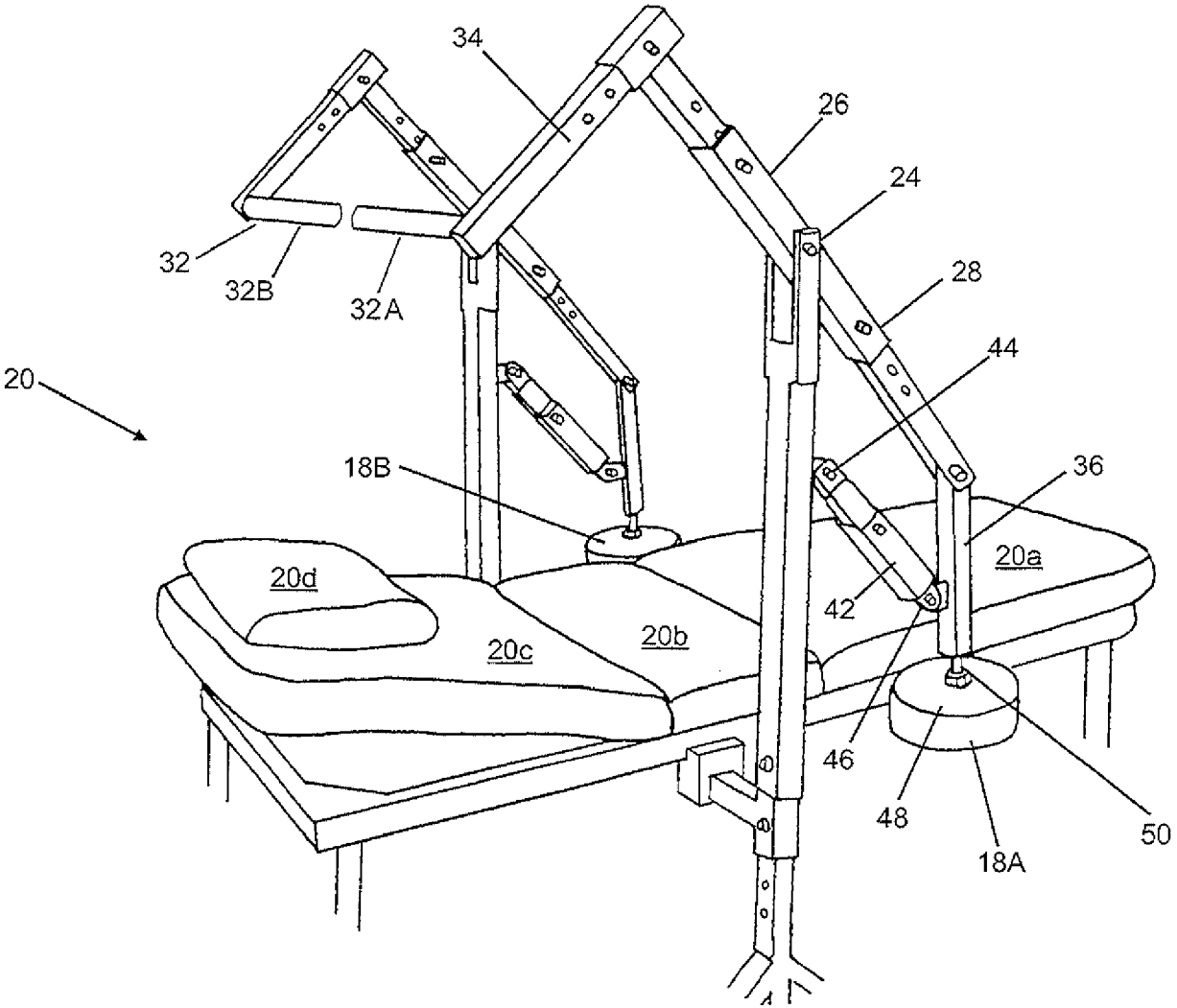
FIG. 6 is a perspective view of one embodiment of the apparatus, essentially shown in its final position.

FIG. 4 gives a perspective view of the same embodiment. This Figure schematically shows a human user in a position using the apparatus. It is clear that the gripping elements provided on the gripping bar (32) or a two-piece gripping bar (32A, 32B), as shown in FIG. 6, can be conveniently held. The arms of the user can be used to control the upward and downward movement of the apparatus. The upward and downward movement of either a single gripping bar (32) or a two-piece gripping bar also provides for exercise of the arms. The positioning of the arms will hold the upper body of the user in a stable position such that no further hold-down devices are required (of course, some anatomically useful support or cushioning is optional).

Figure 5:
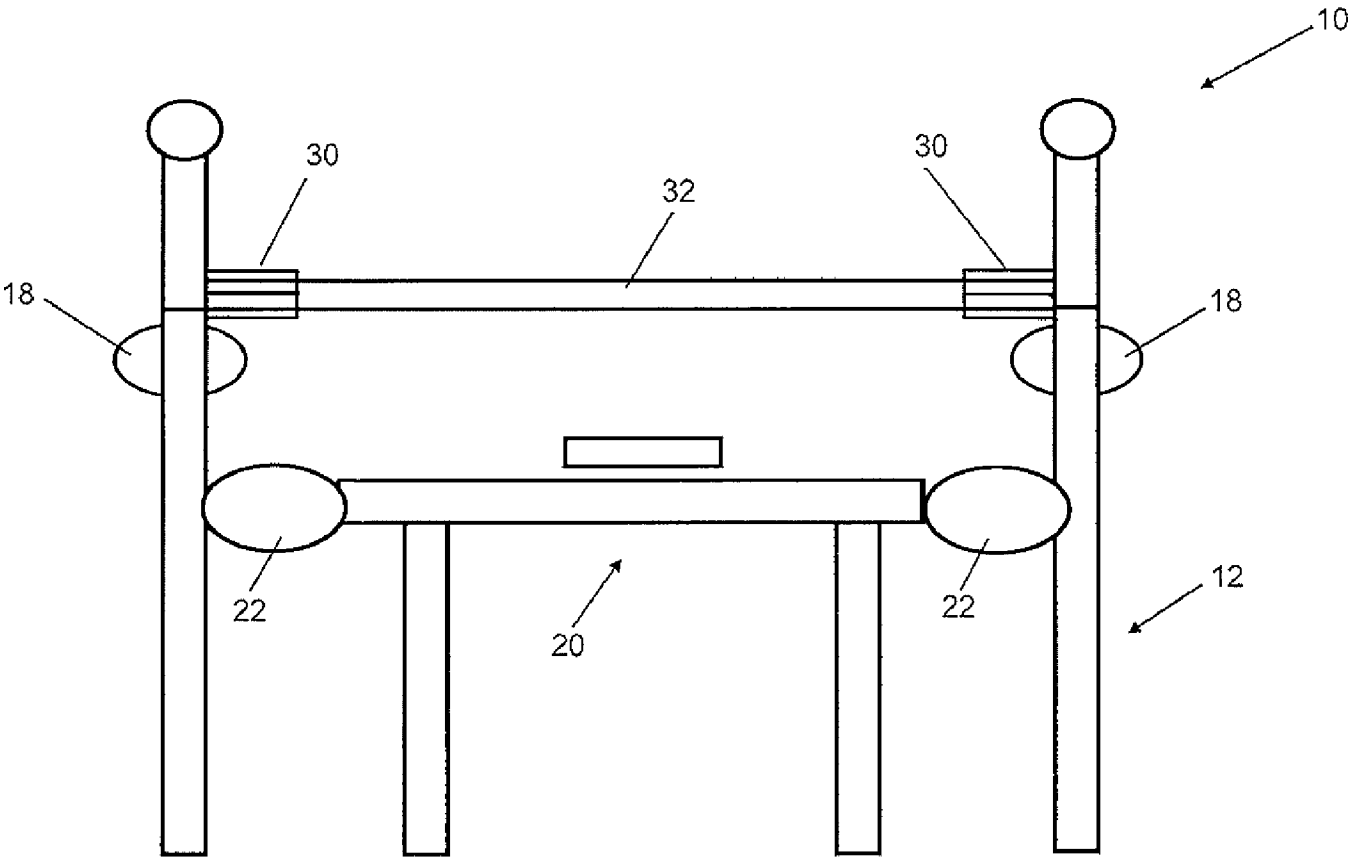
FIG. 5 is a side view of the apparatus, viewing it from its top end.

FIG. 5 is a side view of the apparatus when seen from the top end (the end on which the head rests). It is clear from FIG. 5 that the supporting stand (12) extends laterally beyond the bench. Attachment elements (22) provide for an easy and safe attachment to the bench. A single gripping bar (32) or a two-piece gripping bar, as shown in FIG. 6, allows for a variety of holding positions—either on the gripping elements (30) or in alternative positions. The pressure-exerting elements (18) can move downwards along the lateral sides of the bench and therefore can reach the second position which is below the support level defined by the bench.

FIG. 6 provides a perspective view of one embodiment of the apparatus. The supporting stand (12) comprises two parallel posts, one of each lateral side of the bench (20). The posts are supported by a planar tripod (not fully shown), but other forms of stands or feet are equally suitable. The posts are provided from stainless steel square pipe. The square pipes used for the bottom part measure about 30 millimeters×30 millimeters and have a wall thickness of about 1.5 millimeters.

The posts are adjustable in height. Matching square pipes are used to provide a telescope type extension mechanism. The inner (bottom) square pipe can be extracted from the outer (upper) square pipe. Matching equidistant holes in the inner square pipe and the outer square pipe allow to fix the square pipes in different positions relative to each other and thereby to adjust the lengths of the posts.

The posts support the force transmission element (14), which comprises the first lever (26) and the second lever (28). Both levers are provided from matching stainless steel square pipes to provide a telescope extension mechanism as described above. The outer square pipe for both levers is identical and provided as a single central piece of square pipe. This central square pipe is supported by a bolt, the bolt being carried by parallel plates welded onto the posts of the supporting stand (12). This bolt serves as essential element of the first pivot (24).

The first lever (26), which is length adjustable in the manner described, holds an arm (34) which is perpendicular to the first lever (26). The arm is adjustable in position relative to the first lever by a square pipe telescopic mechanism, as described above.

The second lever (28) is also length adjustable in the manner described and is guided by a four-bar linkage comprising an equally length adjustable arm (42), which is pivotally connected (using bolts) to the post of the supporting stand (12) and the arm (36) linked to the pressure-exerting element (18A).

A pressure-exerting element (18A) comprises a base plate (48). On its bottom side the base plate (48) supports cushioning material, which is provided for a firm yet comfortable contact with the knee area of the user. On its top side, the base plate (48) supports a threaded bar (50) positioned in the center of the base plate (48). The threaded bar (50) extends into a thread at the end of the arm (36). The position of the pressure-exerting element (18A) relative to the arm (36) and thereby relative to the second lever (28) is hence adjustable by turning the pressure-exerting element (18A) about its central axis. The arm (36) may have transparent windows with markings allowing for visual inspection of the position of the threaded bar (50) and thereby to accurately and repeatedly adjust the position of the pressure-exerting element (18A). This construction of the pressure-exerting element is equally useful for any other embodiment of the present invention.

The bench (20) rests on a frame carried by four posts. The bench (20) comprises a support area for the lower body (20*a*), a support area for the central body (20*b*), a support area of the upper body (20*c*) and a cushion (20*d*) for the head of the user. These areas are provided by separate elements (but could in other embodiments also be provided by joined or integral elements). The support area for the upper body (20*c*) is provided by a backrest adjustable in angle. The back of a user would lie on the support area for the upper body (20*c*), the hips of a user would lie on the support area for the central body (20*b*), and the knees would lie on the support area for the lower body (20*a*). Therefore, the first pivot (24) would be proximal to the knees of the user (more towards the head than towards the feet) and would also be ventral (i.e. above the belly of the user).

The posts of the supporting stand (12) are joined to the frame of the bench (20) by arms carrying clamps. The clamps are tightened by screws (not shown) and are essentially friction locked to the frame of the bench (20). Hence, the attachment is releasable.

All elements described so far with respect to FIG. 6 are present at both lateral sides of the bench (20). For simplicity, not all the corresponding elements on the other side are described again. The corresponding pressure-exerting element (18B) is mechanically linked to the corresponding arm joined to the gripping bar (32B), in a manner corresponding to the mechanical linking of the first pressure-exerting element (18B) to the above described arm (34). Alternatively, a mechanical link between both lateral sides is made by a single gripping bar, which joins the respective arms. When length-adjustments are made, all lengths should be chosen to be identical on both lateral sides.

From the foregoing description it is apparent, that the following exercise apparatuses form part of the invention:

a) An exercise apparatus (10) comprising a supporting stand (12) and at least one force transmission element (14), which is associated with a handle element (16) and a pressure-exerting element (18), the apparatus (10) being suitable to exert pressure onto the knee area of a human user and the apparatus (10) allowing the movement of the pressure-exerting element (18) from a first position, in which the pressure-exerting element (18) is in an anterolateral position relative to the body of the user, to a second position of the pressure-exerting element (18), in which the pressure-exerting element (18) is in a posterolateral position, while the pressure-exerting element (18) exerts pressure onto the knee area of the human user.

b) The apparatus (10) of the preceding paragraph, in which the force transmission element (14) comprises a first lever (26) on one side of the first pivot (24) and a second lever (28) on the other side of the first pivot (24), the first lever (26) being on the same side as the handle element (16) relative to the first pivot (24) and the second lever (28) being on the same side as the pressure-exerting element (18) relative to the first pivot (24).

c) The apparatus (10) of the preceding paragraph, which further comprises an arm (34) joining the handle element (16) to the first lever (26).

d) The apparatus (10) of paragraph b) or c), which further comprises an arm (36) joining the pressure-exerting element (18) to the second lever (28).

e) The apparatus of paragraph d), in which the arm (36) joining the pressure-exerting element (18) to the second lever (28) is adjustable in length.

f) The apparatus (10) of any one of the paragraphs a) to e), comprising at least one guiding element (40) to guide the pressure-exerting element (18) in a predetermined direction.

The invention further comprises:

g) An exercise apparatus (10) comprising a supporting stand (12) and at least one force transmission element (14), which is associated with a handle element (16) and a pressure-exerting element (18), in which the force transmission element (14) is moveable about a first pivot (24), wherein the first pivot is positioned in a ventral position relative to the body of a human user.

h) The exercise apparatus (10) of the preceding paragraph, in which the first pivot (24) is in a position that is proximal to the knees of the human user.

All the references described are incorporated by reference in their entirety. From the foregoing description, taken also with the accompanying drawings, it will be apparent that the exercise apparatus is inexpensive to build, but easy and effective to use. Those skilled in the art will appreciate that the invention can be embodied in forms other than herein disclosed for purposes of illustration. Therefore, all numerical values given herein are to be understood as approximate values. Indeed, various modifications and additions can be made and elements presented in the present description in the context of certain other elements, can also be combined with elements presented in other parts of the description to the extent they can be technically combined with these elements.

I claim:

1. A method of exercising comprising:

providing an exercise apparatus, wherein the exercise apparatus comprises a supporting stand and at least one force transmission element coupled to the supporting the at least one force transmission element comprises at least one handle element and at least one pressure-exerting element coupled to the at least one handle element, and wherein the at least one pressure-exerting element is adapted to contact at least one knee of a user and move from a first position, anterolateral to the body of the user, to a second position, posterolateral to the body of the user;

grasping the handle element;

transmitting a force from the handle element to the pressure-exerting element;

moving the pressure-exerting element to contact the at least one knee of the user and to move from a first position, anterolateral to the body of the user, to a second position, posterolateral to the body of the user, wherein the first position is above a bench and the second position is below the bench, and moving the at least one knee simultaneously with the pressure-exerting element from the first position to the second position, wherein the user has a positive stretching and mobilization effect on the lower back, hip joint, and thigh muscles.

2. The method of claim 1, further comprising supporting the body of the user with the bench.

3. An exercise apparatus comprising:

a supporting stand;

a bench coupled to the supporting stand; and at least one force transmission element coupled to the supporting stand comprising:

at least one handle element; and at least one pressure-exerting element having a first position above the bench and a second position below the bench, wherein the at least one pressure-exerting element is coupled to the at least one handle element, wherein the at least one pressure-exerting element is adapted to move from the first position to the second position, wherein the first position is anterolateral to the body of a user and wherein the second position is posterolateral to the body of the user.

4. The exercise apparatus of claim 3, wherein the at least one pressure exerting element is adapted for movement to either the right side or left side of the bench.

5. The exercise apparatus of claim 3, wherein the force transmission element is pivotally mounted to a first pivot positioned above the bench.

6. The exercise apparatus of claim 3, wherein the force transmission element comprises a first lever on one side of the first pivot and a second lever on the other side of the first pivot.

7. The exercise apparatus of claim 3, wherein the at least one pressure exerting element is adapted for adjustment relative to the force transmission element.

8. The exercise apparatus of claim 3, wherein the bench is releasably attached to the supporting stand.

9. The exercise apparatus of claim 3, wherein the bench is permanently attached to the supporting stand.

10. The exercise apparatus of claim 3, further comprising a second pressure-exerting element.

11. The exercise apparatus of claim 3, wherein the force transmission element is pivotally mounted to the apparatus with a first pivot.

12. The exercise apparatus of claim 11, wherein the first pivot is in a position proximal to the knee of the user.

13. The exercise apparatus of claim 11, wherein the first pivot is in a position ventral to the body of the user.

14. The exercise apparatus of claim 3, wherein the supporting stand has one leg.

15. The exercise apparatus of claim 3, wherein the supporting stand is adapted to have a leg on each side of the user.

16. The exercise apparatus of claim 3, wherein the at least one handle element has one gripping element.

17. The exercise apparatus of claim 3, wherein the at least one handle element has two gripping elements.

18. An exercise apparatus comprising:

a supporting stand;

at least one force transmission element coupled to the supporting stand comprising:

at least one handle element, and at least one pressure-exerting element coupled to the at least one handle element wherein the at least one pressure-exerting element is adapted to contact at least one knee of a user and move from a first position, anterolateral to the body of the user, to a second position, posterolateral to the body of the user; and a bench coupled to the supporting stand, wherein the bench supports the lower back of the user, and wherein the at least one pressure-exerting element is adapted to move above the bench and below the bench.

19. The exercise apparatus of claim 17, wherein the bench is releasably attached to the supporting stand.

20. The exercise apparatus of claim 17, wherein the bench is permanently attached to the supporting stand.

* * * * *

UNITED STATES PATENT AND TRADEMARK OFFICE

CERTIFICATE OF CORRECTION

PATENT NO. : 7,976,446 B2
APPLICATION NO. : 12/611583
DATED : July 12, 2011
INVENTOR(S) : Edward Chen It is certified that error appears in the above-identified patent and that said Letters Patent is hereby corrected as shown below:

In the Claims:

At column 9, claim number 1, line numbers 57-59, the paragraph should read as follows:

--a supporting stand and at least one force transmission element coupled to the supporting stand, wherein the at least one force transmission element comprises--

Signed and Sealed this
Thirtieth Day of August, 2011

David J. Kappos

David J. Kappos
*Director of the United States Patent and Trademark Office*